US011066887B2

(12) United States Patent
Al-Mousa et al.

(10) Patent No.: US 11,066,887 B2
(45) Date of Patent: Jul. 20, 2021

(54) WELL CELLAR EXCAVATING DEVICE AND METHOD

(71) Applicant: Saudi Arabian Oil Company, Dhahran (SA)

(72) Inventors: Ahmed Al-Mousa, Dhahran (SA); Ahmed Al-Ramadhan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 145 days.

(21) Appl. No.: 16/556,103

(22) Filed: Aug. 29, 2019

(65) Prior Publication Data

US 2021/0062602 A1 Mar. 4, 2021

(51) Int. Cl.
*E21B 33/03* (2006.01)
*E02D 29/05* (2006.01)

(52) U.S. Cl.
CPC ..... *E21B 33/03* (2013.01); *E02D 29/05* (2013.01)

(58) Field of Classification Search
CPC ..... E02D 29/05; E21B 33/03; E21B 31/00; E21B 31/08; E21B 25/02; E21B 10/26; E21B 10/265
See application file for complete search history.

(56) References Cited

U.S. PATENT DOCUMENTS 3,980,145 A 9/1976 Wibom
4,335,740 A 6/1982 Boley
4,429,754 A 2/1984 Cormier
6,892,834 B1 5/2005 Beck
7,753,113 B1 7/2010 Penisson
7,987,904 B1 8/2011 Rose
8,127,837 B1 3/2012 Rose
8,256,505 B1 9/2012 Rose
10,202,816 B1 2/2019 Stierwalt
2014/0102691 A1 4/2014 Gibson
2015/0167412 A1 6/2015 Jack et al.
2016/0258216 A1 9/2016 Baaske et al.
2018/0087238 A1 3/2018 Falkenhagen
2018/0274301 A1 9/2018 Deul et al.
2018/0274321 A1 9/2018 Arefi et al.

OTHER PUBLICATIONS

PCT International Search Report issued in the Prosecution of patent PCT/US2020/047562, dated Oct. 26, 2020, 14 pages.

*Primary Examiner* — Aaron L Lembo
(74) *Attorney, Agent, or Firm* — Bracewell LLP; Constance Gall Rhebergen

(57) ABSTRACT

A cellar around a wellbore is formed or deepened with an excavating system that is capable of being assembled around an existing wellbore. The system includes an excavating unit having an annular body with a cutting surface that excavates cuttings from ground around the wellbore. The cuttings are directed up through a slot in the body, and are collected inside a receptacle set in a recess of the body. An opening is formed in a side of the receptacle when in the body, and through which the cuttings pass from the slot into the receptacle. The receptacle is removable from within the recess and cuttings collected within are emptied. When the receptacle is removed from the recess, the opening is automatically covered to retain the cuttings inside the receptacle. Another cellar around a different wellbore is formed by disassembling the excavating system and relocating it to the different wellbore.

20 Claims, 4 Drawing Sheets

WELL CELLAR EXCAVATING DEVICE AND METHOD

BACKGROUND OF THE INVENTION

1. Field of Invention

The present disclosure relates to excavating in a cellar circumscribing a wellhead. More specifically, the present disclosure relates to excavating a wellhead cellar with a segmented device that circumscribes the wellhead.

2. Description of Prior Art

Hydrocarbon producing wellbores extend subsurface and intersect subterranean formations where hydrocarbons are trapped. Some type of hardware is typically mounted at the opening of each wellbore during drilling, and over the remaining life of the wellbore. During the time the wellbore is being drilled, the wellhead assembly usually is made up of a wellhead housing mounted over conductor pipe, and with a blow-out prevented ("BOP") mounted on an upper end of the wellhead housing. Also during one stage of drilling, conductor pipe is added which lines an upper portion of the wellbore. After drilling is complete, and prior to producing from the wellbore; the BOP is usually replaced with a production tree for controlling the flow of fluids produced from the wellbore.

A cellar is often formed around an opening of a wellbore, and that extends into the ground a few feet below the Earth's surface. Wellhead cellars are sometimes used as a workspace for operations personnel to access valves and other fluids handling equipment associated with the wellhead assembly. Occasionally, cellars are also configured to capture and collect fluids leaking from wellhead equipment, or that has spilled around the wellhead. Without a cellar, the leaking/spilled fluids might otherwise contaminate the ground around the well. The types of leaking fluids that are collected generally include one or more of drilling fluid, oil, lubricants, or completion fluids. To ensure fluid is collected properly, a cellar is typically lined with sheet metal, fiberglass, or concrete. Because wellbore cellars circumscribe a portion of the associated wellbore, difficulties arise when excavating in an existing wellbore cellar, or when forming a new cellar around a wellbore during production.

SUMMARY OF THE INVENTION

Disclosed herein is an example of a system for excavating around a wellbore, which includes a selectively rotatable excavating unit that is driven by a motor. The excavating unit of this example includes an annular body having a cutting surface selectively disposed in cutting engagement with ground that circumscribes the wellbore, inserts disposed on the cutting surface, a bin removably disposed in a recess the body, a slot formed in the body that extends from the cutting surface to the recess, and a receptacle in the bin that selectively receives cuttings formed by contacting ground around the wellbore with the inserts. When the motor is in an operating mode, the excavating unit is rotating and excavating the cuttings from the ground. In an alternate embodiment, the receptacle receives the cuttings through an opening formed in a sidewall of the bin. In this alternate embodiment, a planar cover is set adjacent the opening when the bin is disposed in the recess, and the cover is urged adjacent the cover when the bin is removed from the recess to define a barrier to communication of cuttings through the opening. In an alternative to this embodiment, a ledge is formed at a location on an inner surface of the recess to be in interfering contact with the cover to space the cover away from the opening when the bin is disposed in the receptacle. In another embodiment, the motor is rotatingly engaged with the excavating unit with a belt. In another embodiment, the annular body is made up of angular segments that each extend along a portion of a circumference of the annular body, and optionally each segment includes a forward wall that is in a forward plane that intersects and is substantially parallel with an axis of the annular body, and a rearward wall that is in a rearward plane that intersects and is substantially parallel with the axis, and wherein the forward plane is oblique with the rearward plane. Further optionally, the angular segments are releasably coupled to one another to form the annular body. In another embodiment, the inserts are disposed rearward of an intersection of the slot and the cutting surface.

Another example of a system for excavating around a wellbore is described, and which includes a motor and an excavating unit. The excavating unit of this example is made up of an annular body that selectively rotates in response to a rotational force received by the motor, a cutting surface defined on an axial end of the body, inserts on the cutting surface that are in selective excavating contact with ground around the wellbore, a bin removeably disposed in the body, and a slot in the body that extends from the cutting surface to the bin, and which receives cuttings formed by the excavating contact of the inserts and the ground. In an alternate embodiment, the body includes curved segments that each form a circumferential portion of the body, and optionally each segment is attached to an adjacent segment by a coupling, and further optionally, each segment has a planar forward wall that attaches to a planar reward wall formed on the adjacent segment.

Also disclosed herein is an example method of excavating around a wellbore, which includes handling an excavating unit that is made up of an annular body, a cutting surface, a receptacle in the body, and a slot that extends from the cutting surface to the receptacle. The method of this example includes mounting the excavating unit around the wellbore so that the cutting surface is in contact with ground circumscribing the wellbore, excavating cuttings from the ground by rotating the body, and directing the cuttings into a receptacle disposed in the body. In an alternate method, excavating cuttings from the ground involves forming a new cellar around the wellbore or deepening an existing cellar that is around the wellbore. Another alternate method further includes removing the receptacle from the body, and emptying the cuttings from the receptacle, and optionally further includes blocking communication between the slot and the receptacle when the receptacle is removed from the body. In another alternative, the body has segments that each circumscribe a portion of the wellhead, and wherein mounting the excavating unit includes assembling the excavating unit by attaching the segments to one another. In another alternative, a wellhead assembly is coupled with the wellbore while the excavating unit is being mounted around the wellbore. In another alternative, the wellbore is a first wellbore and the excavating unit is removed from the first wellbore, and the excavating unit is then mounted around a second wellbore that is spaced away from the first wellbore, and ground from around the second wellbore is excavated with the excavating unit.

BRIEF DESCRIPTION OF DRAWINGS

Some of the features and benefits of the present invention having been stated, others will become apparent as the description proceeds when taken in conjunction with the accompanying drawings, in which.

Figure 1:
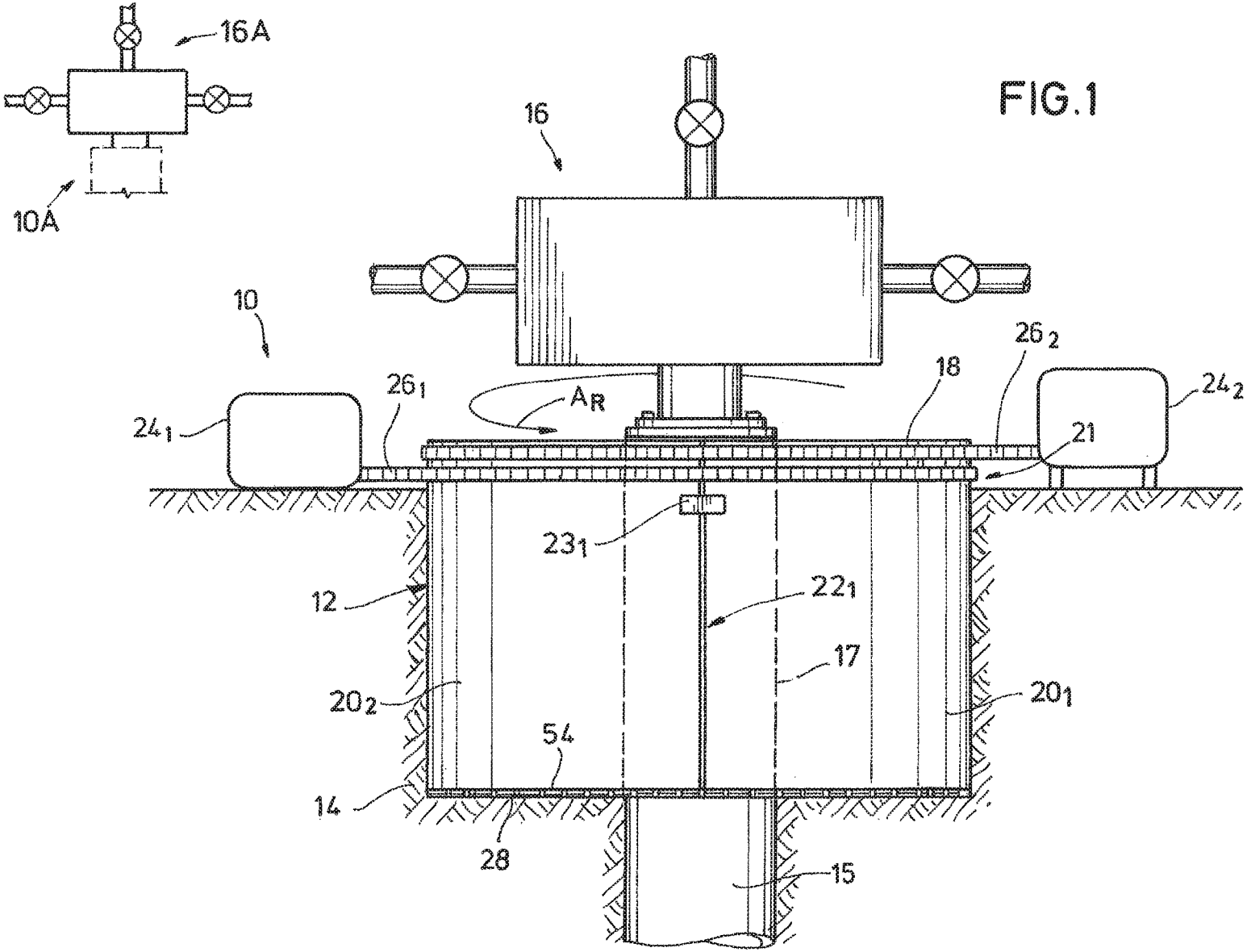
FIG. 1 is a side partial sectional view of an example of an excavating unit excavating in a wellbore cellar.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side partial sectional view in FIG. 1 is an example of a cellar excavating system 10 excavating in a wellbore cellar 12. As shown, the wellbore cellar 12 extends into ground 14 that circumscribes a portion of a wellbore 15. Mounted above wellbore 15 is an example of a wellhead assembly 16, and the portion of wellbore 15 depicted is circumscribed by a conductor pipe 17 that depends downward from wellhead assembly 16. Included in the excavating system 10 is an annular excavating unit 18, which as described in more detail below is made up of segments $\mathbf{20}_1$, $\mathbf{20}_2$ that each form an angular portion along a circumference of the excavating unit 18. When combined, segments $\mathbf{20}_1$, $\mathbf{20}_2$ define a body 21; and as shown segments $\mathbf{20}_1$, $\mathbf{20}_2$ join one another along an interface $\mathbf{22}_1$, which follows a path parallel with an axis $A_X$ of excavating body 18. An optional coupling $\mathbf{23}_1$ is shown mounted across interface $\mathbf{22}_1$ and for providing a coupling means for attaching segments $\mathbf{20}_1$, $\mathbf{20}_2$ together.

Motors $\mathbf{24}_{1,2}$ are shown above ground 14 and outside of wellbore cellar 12, and which respectively couple with excavating unit 18 by belts $\mathbf{26}_{1,2}$. Belts $\mathbf{26}_{1,2}$ are elongate flexible members formed into a continuous loops, and with sufficient structural integrity to exert a force that causes rotation of excavating unit 18 within wellbore cellar 12. As illustrated by arrow $A_R$, excavating unit 18 is rotated within wellbore cellar 12 by forces generated by operation of motors $\mathbf{24}_{1,2}$ and their coupling with the belts $\mathbf{26}_{1,2}$, which transfers the forces to the excavating unit 18. Alternate embodiments exist where a single motor 24 and single belt 26 are used for driving the excavating unit 18. The cellar bottom 28 is formed on a lowermost surface within wellbore cellar 12 and distal from wellhead assembly 16.

Figure 2:
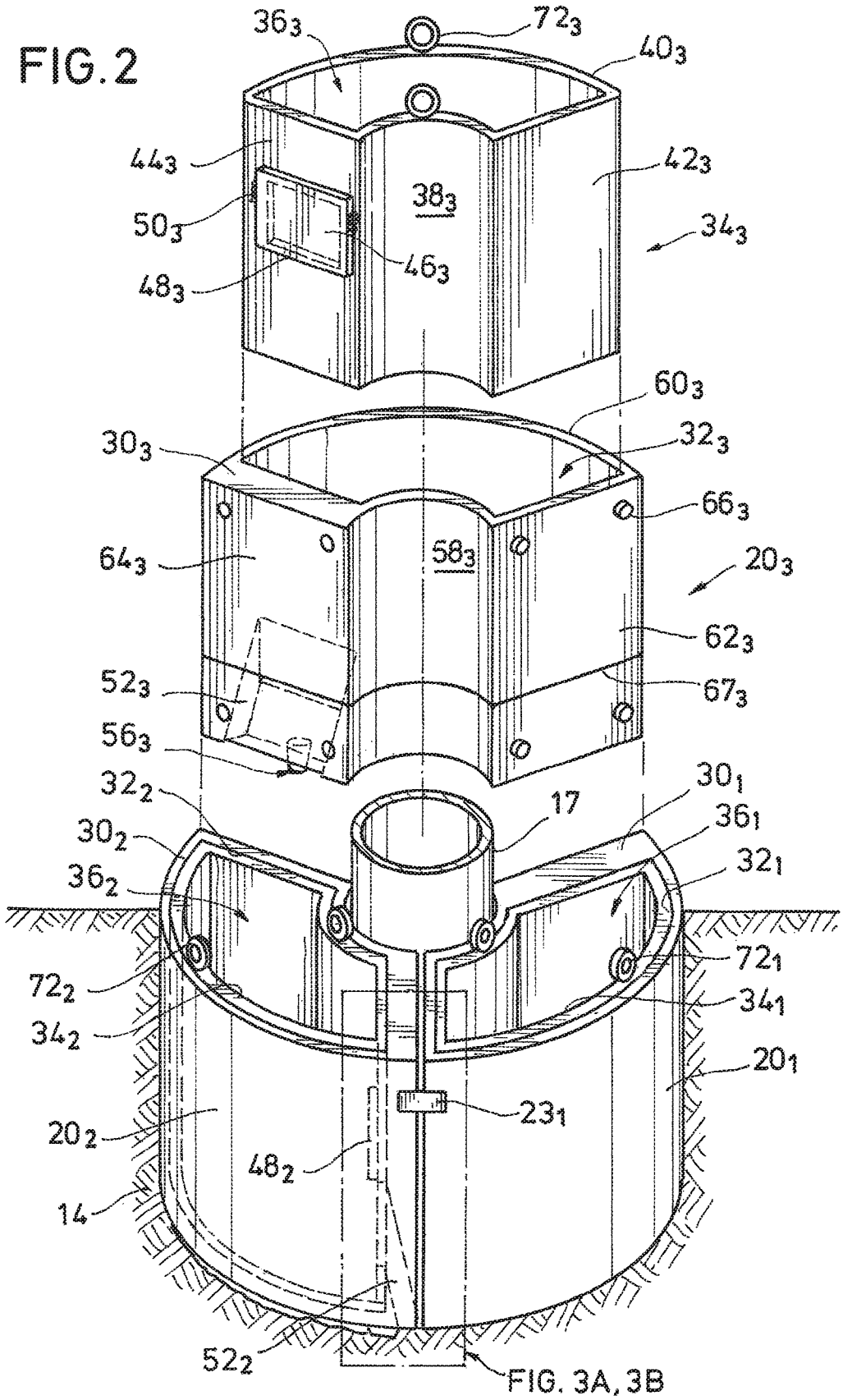
FIG. 2 is a partially exploded perspective view of an example of the excavating unit of FIG. 1

Shown in FIG. 2 is a perspective partially exploded view of the excavating unit 18, and illustrating that the segments $\mathbf{20}_{1\text{-}3}$ making up the body 21 each extend roughly same angular distance around the circumference of unit 18; but embodiments exist where the particular segments $\mathbf{20}_{1\text{-}3}$ each extend a different angle about axis $A_X$. As illustrated in FIG. 2, each segment $\mathbf{20}_{1\text{-}3}$ includes a housing $\mathbf{30}_{1\text{-}3}$ having a recess $\mathbf{32}_{1\text{-}3}$; each recess $\mathbf{32}_{1\text{-}3}$ is open on an upper end, is closed on a lower end, and has sidewalls spanning between the upper and lower ends, and which extend along a portion of the axial length of each of the segments $\mathbf{20}_{1\text{-}3}$. In one embodiment, radial widths of each of the recesses $\mathbf{32}_{1\text{-}3}$ is substantially the same along their respective azimuths and depths. In the example of FIG. 2, for the purposes of illustration segment $\mathbf{20}_3$ is shown detached from segments $\mathbf{20}_{1,2}$. Also shown is a bin $\mathbf{34}_3$ shown having a semi-circular wedge-like configuration similar to segment $\mathbf{20}_3$ is spaced above segment $\mathbf{20}_3$. In this example, each recess $\mathbf{32}_{1\text{-}3}$ receives a bin $\mathbf{34}_{1\text{-}3}$ that is selectively removable from within their respective recesses $\mathbf{32}_{1\text{-}3}$. Similar to the recesses $\mathbf{32}_{1\text{-}3}$, each of the bins $\mathbf{34}_{1\text{-}3}$ is open on their respective upper axial ends, and closed on their lower ends; which defines receptacles $\mathbf{36}_{1\text{-}3}$ within each of the bins $\mathbf{34}_{1\text{-}3}$. In FIG. 2, bin $\mathbf{34}_3$ is shown outside of its recess $\mathbf{32}_3$ for purposes of illustration. As shown, bin $\mathbf{34}_3$ includes an inner wall $\mathbf{38}_3$ facing radially inward towards the conductor pipe 17 (when installed), and an outer wall $\mathbf{40}_3$ on a side radially spaced away from inner wall $\mathbf{38}_3$. A planar rearward wall $\mathbf{42}_3$ spans between the inner and outer walls $\mathbf{38}_3$, $\mathbf{40}_3$ and upward from the lower closed end. When bin $\mathbf{34}_3$ is set within recess $\mathbf{32}_3$, rearward wall $\mathbf{42}_3$ is in a plane that intersects with axis $A_X$. A planar forward wall $\mathbf{44}_3$ spans upward from the lower closed end and between ends of the inner and outer walls $\mathbf{38}_3$, $\mathbf{40}_3$ opposite from rearward wall $\mathbf{42}_3$, forward wall $\mathbf{44}_3$ lies in a plane that also intersects axis $A_X$. As shown, forward wall $\mathbf{44}_3$ is arranged substantially oblique to rearward wall $\mathbf{42}_3$.

In the example of FIG. 2 an opening $\mathbf{46}_3$ is shown in a dashed outline, which is formed through forward wall $\mathbf{44}_3$; a cover $\mathbf{48}_3$ is shown set over opening $\mathbf{46}_3$, and which blocks communication from within receptacle $\mathbf{36}_3$ past forward wall $\mathbf{44}_3$ through opening $\mathbf{46}_3$. A retaining means $\mathbf{50}_3$ is shown coupled with cover $\mathbf{48}_2$ and also with forward wall $\mathbf{44}_3$ for retaining the cover $\mathbf{48}_3$ in the position over opening $\mathbf{46}_3$. In one example, retaining means $\mathbf{50}_3$ is a resilient member, such as a spring, and in an example will deform under an applied force and allow sliding movement of cover $\mathbf{48}_3$ away from opening $\mathbf{46}_3$. Still referring to FIG. 2, a slot $\mathbf{52}_3$ is shown in dashed outline formed through the housing $\mathbf{30}_3$ of segment $\mathbf{20}_3$. Slot $\mathbf{52}_3$ extends from a cutting surface 54 which is on a side of the excavating unit 18 opposite from the upper open ends of the recess $\mathbf{32}_{1\text{-}3}$ and the bins $\mathbf{34}_{1\text{-}3}$. Also shown in dashed outline in on cutting surface is an insert $\mathbf{56}_3$ which provides an excavating function for cutting through the ground 14 by rotation R of the excavating unit 18.

Still referring to FIG. 2, the exploded example illustrates that similar to the bin $\mathbf{34}_3$, segment $\mathbf{20}_3$ includes a planar inner wall $\mathbf{58}_3$ which is curved and on a side of segment $\mathbf{20}_3$ facing radially inward towards conductor pipe 17. Radially outward from inner wall $\mathbf{58}_3$ is a planar outer wall $\mathbf{60}_3$. Planar rearward and forward walls $\mathbf{62}_3$, $\mathbf{64}_3$ extend upward from a lower wall of segment $20_3$ and radially between opposing edges of inner wall $58_3$ and outer wall $60_3$. When segment $20_3$ is installed with excavating unit 18 each of the rearward and forward ends $62_3$, $64_3$ are in planes that are parallel with and intersect axis $A_X$, and rearward and forward walls $62_3$, $64_3$ are oblique with one another. Shown on rearward and forward walls $62_3$, $64_3$ is an alternate embodiment of an attachment for coupling together adjacent segments $20_{1-3}$ and which is made up of lugs $66_3$ shown as members projecting generally perpendicular from the rearward and forward walls $62_3$, $64_3$ and having cylindrically shaped portions. Further optionally as shown in FIG. 2, the body 21 may be made up axial segments as well as angular segments; where each axial segment extends along a portion of the axis $A_X$ of excavating unit 18. An example of a radial interface $67_3$ is illustrated indicating where axial segments of angular segment $20_3$ are joined, to demonstrate an embodiment of angular segment $20_3$ being made up of axial segments.

Figure 3A:
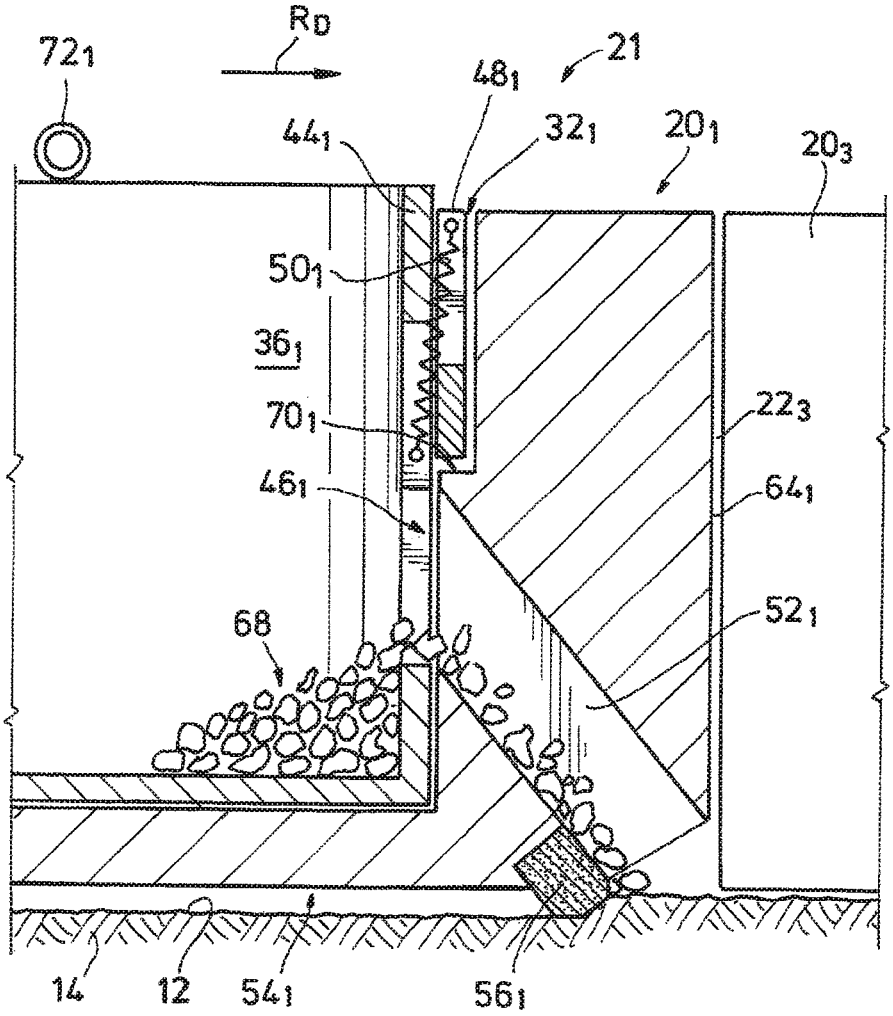
FIGS. 3A and 3B are side sectional schematic views of an example of excavating with the excavating unit of FIG. 1.
Figure 3B:
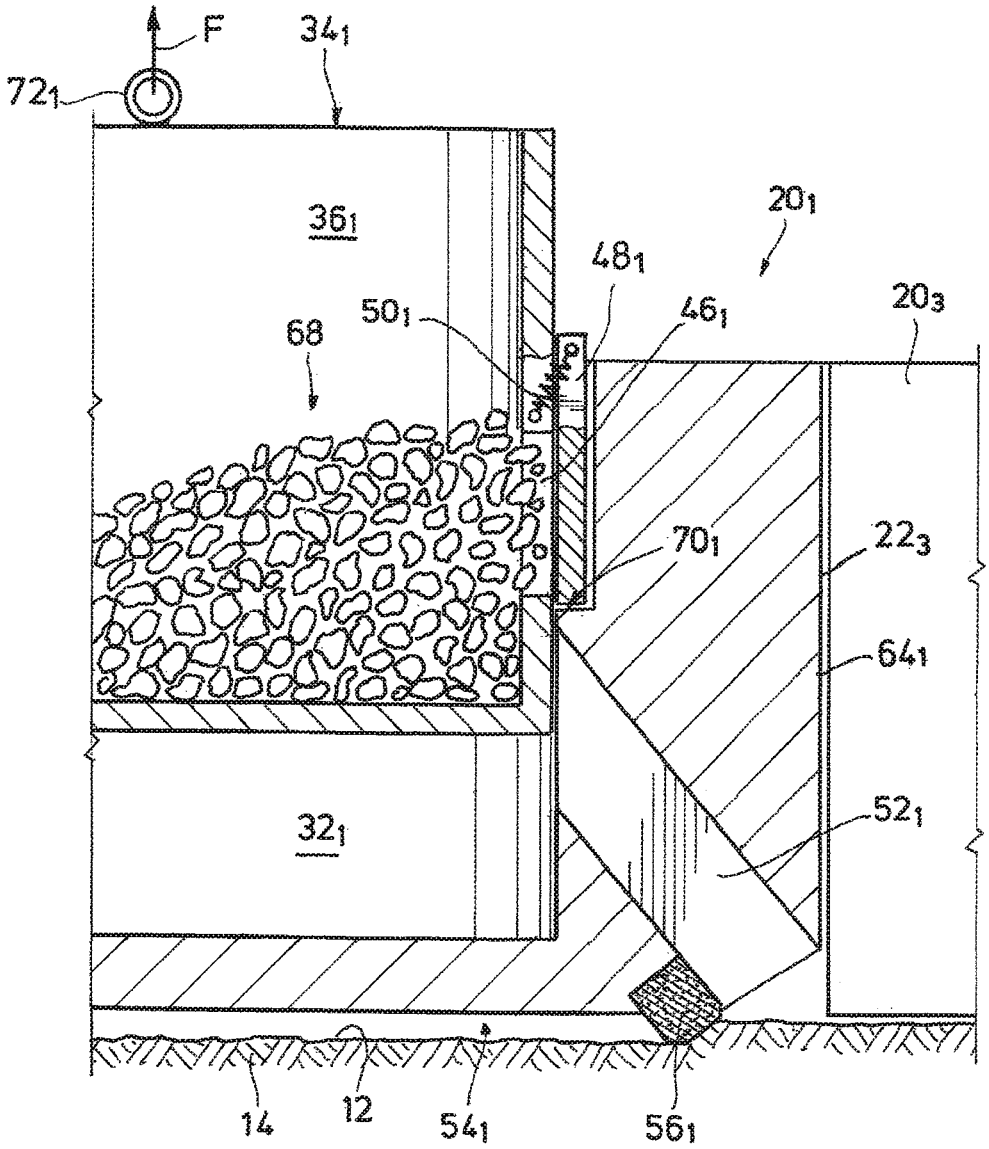

Referring now to FIGS. 3A and 3B, shown in a side sectional view is a non-limiting example of the excavating unit 18 being rotated over the ground 14 to excavate within the wellbore cellar 12. More specifically, referring to FIG. 3A, a portion of segment $20_1$ is shown being rotated in a direction represented by arrow $R_D$. The rotation causes insert $56_1$ to scrape along a surface of ground 14, the scraping interaction between insert $56_1$ and ground 14 removes pieces of the ground to produce cuttings 68; which are shown being directed into receptacle $36_1$ of bin $34_1$. As depicted in FIG. 3A, bin $34_1$ set within recess $32_1$ and cover $48_1$ is spaced away from opening $46_1$ and in a retracted configuration. In the example of FIG. 3A, a ledge $70_1$ is shown that extends radially along a forward facing sidewall of recess $32_1$ and is where an angular length of recess $32_1$ transitions lower. The portion of bin $34_1$ below the bottom of cover $48_1$ is insertable into the portion of recess $32_1$ below ledge $70_1$. However, in the illustrated embodiment, the dimensions of this lower portion are insufficient to accommodate the bin $34_1$ with the cover $48_1$, which results in cover $48_1$ landing on ledge $70_1$ when bin $34_1$ inserts into recess $32_1$. Interference between ledge $70_1$ and cover $48_1$ urges cover $48_1$ into the retracted configuration and away from opening $46_1$; which allows registration between slot $52_1$ and opening $46_1$ to allow communication of the cuttings 68 through body 21 and into bin $34_1$. Also noted is the configuration and placement of insert $56_1$ on a downward side of where slot $52_1$ intersects with cutting surface $54_1$. Positioning of insert $56_1$ on the downward side in one example helps guide cuttings 68 into an opening of slot $52_1$ and for easing their travel into the receptacle $36_1$.

In the example of FIG. 3B receptacle $34_1$ is being removed from recess $32_1$ for the emptying of the cuttings 68. In this example, at a point in time when an amount of cuttings 68 has entered the bin $34_1$ to occupy a designated amount of space within receptacle $36_1$ a force F is applied to the bin $34_1$ and pull it from recess $32_1$. In this example, optional eyehooks $72_1$ are provided with the bin $34_1$ to provide a place where force F is applied. Also noted in the example of FIG. 3B is that as the bin $34_1$ is drawn from within the recess $32_1$, interfering contact between ledge $70_1$ and cover $48_1$ is removed so that the urging means $50_1$ draws cover $48_1$ back adjacent opening $46_1$ to block the escape of the cuttings 68 through opening $46_1$. After emptying the cuttings 68 from within bin $38_1$, bin $34_1$ is placed back into recess $32_1$ for further excavation of cellar.

Referring back to FIG. 1, in one non-limiting example of operation, segments $20_{1-3}$ of excavating unit 18 are handled and positioned proximate the wellhead assembly 16. As noted above, the configuration of the excavating unit 18 with the multiple segments $20_{1-3}$ allows for assembly of the excavating unit 18 onsite and at a wellhead assembly 16. One or both motors $26_{1,2}$ are coupled with the assembled excavating unit 18 and rotation is imparted upon unit 18 to begin excavating cuttings 68 (FIG. 3A) from ground 14 so that wellbore cellar 12 is either deepened or newly formed. As noted above, a designated amount of cuttings 68 occupy the receptacle $36_{1-3}$ the associated bin $34_{1-3}$ is temporarily removed and the cuttings 68 emptied therefrom. Further in this example, after placing the emptied bin $34_{1-3}$ back into its recess $32_{1-3}$, excavation within wellbore cellar 12 resumes. At a time when a wellbore cellar 12 of a designated depth is achieved, the cellar excavating system 10 is disassembled and removed; and in one example taken to a second wellhead assembly 16A which is spaced away from wellhead assembly 16. In this example, cellar excavating system 10 is reassembled as for deepening or creating a new cellar adjacent wellhead assembly 16A.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for excavating around a wellbore, the system comprising:

a selectively rotatable excavating unit comprising, an annular body having a cutting surface selectively disposed in cutting engagement with ground that circumscribes the wellbore, inserts disposed on the cutting surface, a bin removably disposed in a recess of the body, a slot formed in the body that extends from the cutting surface to the recess, and a receptacle in the bin that selectively receives cuttings formed by contacting ground around the wellbore with the inserts; and a motor rotatingly engaged with the excavating unit, so that when the motor is in an operating mode the excavating unit is rotating and excavating the cuttings from the ground.

2. The system of claim 1, wherein the receptacle receives the cuttings through an opening formed in a sidewall of the bin.

3. The system of claim 2, wherein a planar cover is set adjacent the opening when the bin is disposed in the recess, and the cover is urged adjacent the cover when the bin is removed from the recess to define a barrier to communication of cuttings through the opening.

4. The system of claim 3, wherein a ledge is formed at a location on an inner surface of the recess to be in interfering contact with the cover to space the cover away from the opening when the bin is disposed in the receptacle.

5. The system of claim 1, wherein the motor is rotatingly engaged with the excavating unit with a belt.

6. The system of claim 1, wherein the annular body comprises angular segments that each extend along a portion of a circumference of the annular body.

7. The system of claim 6, wherein each segment comprises a forward wall that is in a forward plane that intersects and is substantially parallel with an axis of the annular body, and a rearward wall that is in a rearward plane that intersects and is substantially parallel with the axis, and wherein the forward plane is oblique with the rearward plane.

8. The system of claim 6, wherein the angular segments are releasably coupled to one another to form the annular body.

9. The system of claim 1, wherein the inserts are disposed rearward of an intersection of the slot and the cutting surface.

10. A system for excavating around a wellbore, the system comprising:

a motor; and an excavating unit that comprises, an annular body that selectively rotates in response to a rotational force received by the motor, a cutting surface defined on an axial end of the body, inserts on the cutting surface that are in selective excavating contact with ground around the wellbore, a bin removeably disposed in the body, and a slot in the body that extends from the cutting surface to the bin, and which receives cuttings formed by the excavating contact of the inserts and the ground.

11. The system of claim 10, wherein the body comprises curved segments that each form a circumferential portion of the body.

12. The system of claim 11, wherein each segment is attached to an adjacent segment by a coupling.

13. The system of claim 12, wherein each segment comprises a planar forward wall that attaches to a planar reward wall formed on the adjacent segment.

14. A method of excavating around a wellbore, the method comprising;

handling an excavating unit that comprises, an annular body, a cutting surface, a receptacle in the body, and a slot that extends from the cutting surface to the receptacle;

mounting the excavating unit around the wellbore so that the cutting surface is in contact with ground circumscribing the wellbore;

excavating cuttings from the ground by rotating the body; and directing the cuttings into a receptacle disposed in the body.

15. The method of claim 14, wherein the step of excavating cuttings from the ground comprises forming a new cellar around the wellbore or deepening an existing cellar that is around the wellbore.

16. The method of claim 14, further comprising removing the receptacle from the body, and emptying the cuttings from the receptacle.

17. The method of claim 16, further comprising blocking communication between the slot and the receptacle when the receptacle is removed from the body.

18. The method of claim 14, wherein the body comprises segments that each circumscribe a portion of the wellhead, and wherein the step of mounting the excavating unit comprises assembling the excavating unit by attaching the segments to one another.

19. The method of claim 14, wherein a wellhead assembly is coupled with the wellbore during the step of mounting the excavating unit around the wellbore.

20. The method of claim 14, wherein the wellbore comprises a first wellbore, the method further comprising removing the excavating unit from the first wellbore, mounting the excavating unit around a second wellbore that is spaced away from the first wellbore, and excavating ground from around the second wellbore with the excavating unit.

* * * * *